United States Patent [19]

Bortnikov et al.

[11] Patent Number: 4,936,978

[45] Date of Patent: Jun. 26, 1990

[54] UNIT FOR POSTHARVEST TREATMENT OF SUNFLOWER SEEDS

[76] Inventors: Anatoly I. Bortnikov, Shkolnaya, 15, kv. 125; Vasily D. Shaforostov, Pushkina, 35, kv. 34; Vladimir G. Matjusha, Filatova, 17a, kv. 24; Vladimir I. Efimchenko, Lenina, 70, kv. 42; Leonty I. Tolstonosov, Novorossiiskaya, 182, kv. 27; Jury T. Shkuratov, Voroshilova, 115, kv. 42, all of Krasnodar; Valentin V. Alshits, Orekhovy bulvar, 5, kv. 237, Moscow, all of U.S.S.R.

[21] Appl. No.: 327,329

[22] Filed: Mar. 22, 1989

[51] Int. Cl.[5] ..... B07B 1/04

[52] U.S. Cl. ..... 209/10; 209/19; 209/30; 209/44

[58] Field of Search ..... 209/10, 30, 19, 44

[56] References Cited

U.S. PATENT DOCUMENTS

| | | | |
|---|---|---|---|
| 4,059,604 | 11/1977 | Kresse | 209/10 |
| 4,467,560 | 8/1984 | Simäk | 209/2 |
| 4,785,761 | 11/1988 | Greenbank | 209/10 |

OTHER PUBLICATIONS

TSITEP Selkhozzerno, Krasnodar 1980.

*Primary Examiner*—Robert R. Song

*Attorney, Agent, or Firm*—Burgess, Ryan & Wayne

[57] ABSTRACT

The present invention provides containers or storage bins for separate storage of the seeds of each size fraction in the course of their postharvest ripening, interposed between the primary and secondary seed cleaners and connected to the secondary cleaner through a conveyer, which effects a separate feed of the seeds of each size fraction for further treatment.

1 Claim, 1 Drawing Sheet

UNIT FOR POSTHARVEST TREATMENT OF SUNFLOWER SEEDS

TECHNICAL FIELD

The invention relates generally to equipment for mass treatment of seeds and more specifically to a unit for postharvest treatment of sunflower seeds.

The invention can find application in the food industry and in agriculture.

DESCRIPTION OF THE PRIOR ART

At present sunflower seeds are treated in a technological plant, incorporating devices for preliminary, primary, secondary and special seed cleaning arranged in a sequence of technological procedures and interconnected through a system of conveyers. A seed store is provided in between the primary and secondary cleaning devices, wherein the seed mixture is kept within the period of postharvest ripening. Once the afterripening period has been over the seed mixture is subjected to laboratory analysis for condition, and lots of seeds exhibiting low sowing qualities are rejected, while good-quality seed lots are forwarded to the secondary and special cleaning devices, wherein the seeds are upgraded to good sowing conditions as for cleanness.

However, treatment of the entire seed mixture in the aforesaid plant without separating said mixture into size fractions results in a reduced yield of cleaned seed material, since one cannot select an optimum operating mode for cleaning devices in treating seed mixture consisting of seeds with different physico-mechanical characteristics.

Among the heretofore-known plants of the character set forth above the closest to that disclosed herein as to its technical essence and the result attained is a unit for treatment and storage of sunflower seeds, comprising devices for preliminary cleaning, primary cleaning and size classification, secondary cleaning and separation into size fractions, and special cleaning, said devices being interconnected through a system of conveyers and arranged in a sequence of technological procedures (of. an advertizing prospectus "Plant for treatment and storage of sunflower seeds", issued by the TsITEP selkhozzerno, Krasnodar, 1980).

The aforedescribed unit operates concurrently with harvesting according to the following process flowsheet: receiving a lot of seeds from motor transport vehicles; precleaning of harvested seed mixture; temporary storage and drying of precleaned seeds in positively ventilated bins; primary cleaning of seeds accompanied by isolation of fraction III; secondary cleaning accompanied by separation of the seed mixture into fractions I and II; sorting of seeds; packaging of seeds; prolonged storage of seeds in a seed storehouse; seed dressing; and dispensation of the thus-treated seeds.

The aforediscussed unit is too sophisticated due to the fact that each of the size fractions is treated in its own process line (a train of devices). Analysis for condition of seeds (their sowing qualities) is carried out of already cleaned and packaged seeds after their having passed through the postharvesting ripening period. Should the germination capacity of seeds be reduced, such seeds are returned for repeated grading in the secondary and special cleaning devices. This affects badly the yield of sound seeds and increases operating costs. Furthermore, use of several parallel technological lines at a final stage of seed treatment involves much capital and operating costs.

It is an essential object of the invention to provide a unit for postharvesting treatment of sunflower seeds having containers for separate storage of seeds of each size fraction.

It is another object of the invention to provide a higher yield of cleaned seed material.

It is one more object of the invention to increase the utilization factor of the unit.

And it is also an object of the invention to simplify the construction of the unit as a whole.

SUMMARY OF THE INVENTION

The foregoing and further objects are accomplished due to the fact that in a unit for postharvest treatment of sunflower seeds, comprising devices for precleaning, primary cleaning and seed separation into size fractions, secondary cleaning and special cleaning, arranged in a sequence of technological procedures and interconnected through a system of conveyers, according to the invention, provision is made for containers for separate storage of the seeds of each size fraction in the course of their postharvest ripening, said containers being interposed between the devices for primary and secondary cleaning and connected to the secondary cleaning device through a conveyer adapted for a separate feed of the seeds of each size fraction for further treatment.

Such a process flow-sheet of the unit provides for a higher yield of the seed material and simplifies its construction.

The essence of the proposed invention resides in that the unit for postharvest treatment of sunflower seeds is provided with containers for separate storage of the seeds of each size fraction in the course of their postharvest ripening. This makes it possible, after the period of postharvest seed ripening has been over, to carry out a laboratory analysis of the seeds of each size fraction separately in order to find out an optimum scope of work for further seed treatment differentially with respect to each size fraction, as well as further ways of utilization of each fraction. In particular, this ensures, for instance, a possibility of choosing specific conditions of further treatment of the seeds of each size fraction, which makes it possible to optimize the treatment process of each size fraction and hence to increase the yield of cleaned seed material.

The fact that the containers for separate storage of the seeds of each size fraction are interposed just between the devices for primary and secondary cleaning predetermines a required and adequate scope of work aimed at treatment of seeds before their laying-in for postharvesting ripening so as to bring them to a stable condition ensuring their preservation without impairing the quality of seeds and also makes it possible to optimize the process of further treatment of seeds and of final determining of their sowing qualities.

Communication between the containers and the secondary cleaning device through a conveyer which carries out separate feeding of the seeds of each size fraction for further treatment makes it possible to perform subsequent treatment processes of the seed material in succession whenever it becomes necessary and only on a single process flow line. Performing the secondary and special cleaning on the same process flow line required much less number of conveyance means, which contributes to a higher yield of the cleaned seed material.

All this results in a 5-percent increase in the yield of the seed material, reduces capital investment by 20 percent and operating costs by 15 percent.

BRIEF DESCRIPTION OF THE DRAWINGS

Given below is a specific exemplary embodiment of the invention illustrated by the accompanying Drawing, wherein.

BEST MODE OF CARRYING OUT THE INVENTION

Figure 1:
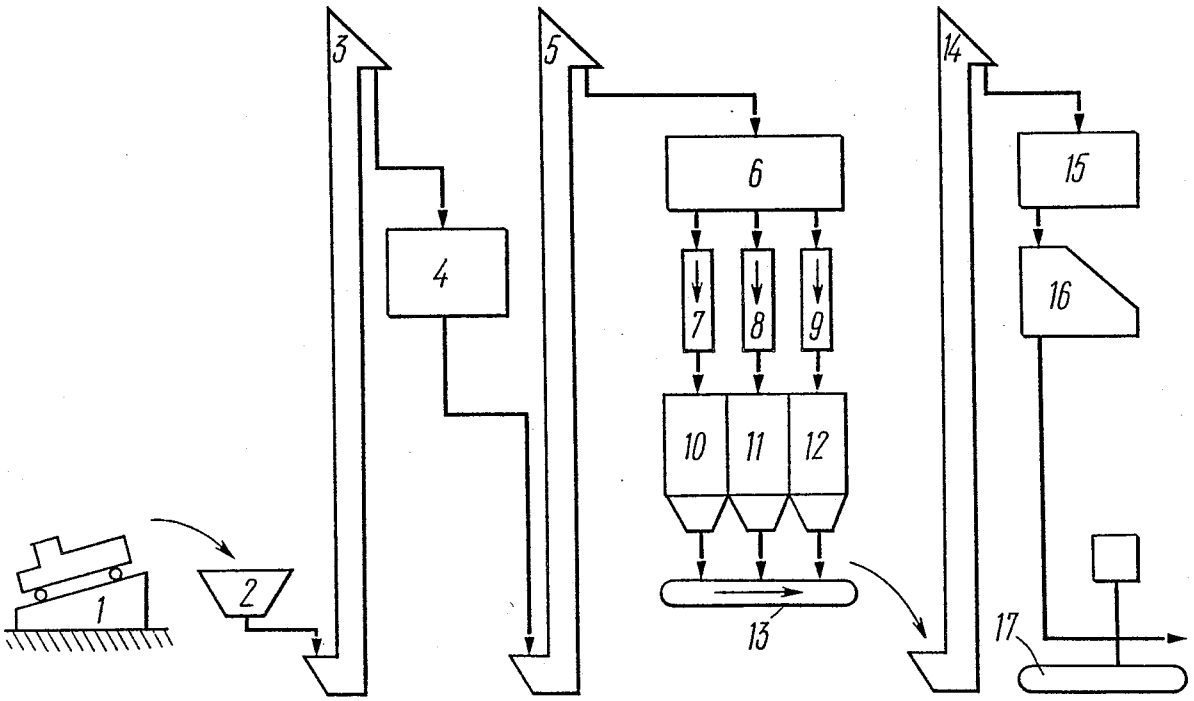
FIG. 1 shows diagrammatically the proposed unit.

The unit (FIG. 1) for postharvest treatment of sunflower seeds comprises any heretofore-known device for unloading motor transport vehicles, such as a truck tipper 1, a reception device (hopper) 2, interconnected through a vertical conveyer 3, to a seed material precleaner 4, which is connected, through a vertical conveyer 5, to a device 6, for primary cleaning and seed separation into size fractions, belt conveyers 7, 8, 9 connected to respective containers 10, 11, 12 for separate storage of the seeds of each size fraction in the course of their postharvest ripening, a load transfer means, i.e., a belt conveyer 13 adapted for a separate feed of the seeds of each size fraction from each of the containers with the aid of a vertical conveyer 14, to a secondary seed cleaner 15, a special seed cleaning device 16, and finally to a seed dispensing and packaging device 17.

The unit of the invention operates as follows.

The original seed mixture is discharged from a truck by the truck tipper 1, and fed to the receiving hopper 2, whence it is fed by gravity to the vertical conveyer 3, and further to the seed precleaner 4, wherein the seed material gets rid of large impurities and fine trash. Then the seed material cleaned of the aforesaid impurities is fed, through the vertical conveyer 5, to the device 6, for primary cleaning of seeds and their separation into size fractions, wherein fine and large-sized impurities are eliminated and the seeds are separated into, e.g., three size fractions I, II, III, whereupon each of said fractions is fed, by the respective conveyer 7, 8, 9, to the respective containers (storage bins) 10, 11, 12. It is in said storage bins that the seeds of each size fractions are stored separately in the course of their postharvest ripening, thus ensuring preservation of the seed material till the end of the afterripening (rest) period. After the rest period has been over, data on the germination capacity of seeds in obtained and the specific conditions of further seed treatment are chosen, and each of the seed size fractions is fed, whenever necessary, by way of the conveyer 13, to the vertical conveyer 14 and further on to the secondary seed cleaner 15, wherein hulled or wrinkled seeds are eliminated. Next the seeds cleaned from the above impurities are fed to the special seed cleaning device 16, e.g., to a gravity air table, whereon defective seeds and hard-to-separate impurities are removed. The thus-cleaned seed material is fed to the dispensing and packaging device 17, wherein the seed material is packaged into sacks, which are sewn up and sent for storage or for sale.

INDUSTRIAL APPLICABILITY

The present invention is efficiently applicable in agriculture and in the food industry for treatment of cereal, leguminous and oil-bearing crops, and can find most utility when used in large seed-production farms, wherein mass treatment of seeds is effected.

What is claimed is:

1. A unit for postharvest treatment of sunflower seeds, comprised of, in combination:

(a) a seed precleaner;

(b) a seed primary cleaner and separator for separating seeds by size;

(c) a seed secondary cleaner;

(d) a seed special cleaner;

(e) storage containers interposed between said primary and secondary cleaners for separate storage of seeds of each size in the course of their postharvest ripening; and (f) a system of conveyors whereby each one of said storage containers is connected to said seed secondary cleaner by a separate conveyor.

* * * * *